US005722600A

United States Patent [19]

Horiuchi

[11] Patent Number: 5,722,600

[45] Date of Patent: Mar. 3, 1998

[54] FUEL INJECTION DEVICE FOR INTERNAL COMBUSTION ENGINES

[75] Inventor: Shigeaki Horiuchi, Fujisawa, Japan

[73] Assignee: Isuzu Motors Limited, Tokyo, Japan

[21] Appl. No.: 679,180

[22] Filed: Jul. 12, 1996

[30] Foreign Application Priority Data

Jul. 14, 1995 [JP] Japan ..... 7-200310

[51] Int. Cl.[6] ..... F02M 47/02

[52] U.S. Cl. ..... 239/533.8

[58] Field of Search ..... 239/533.3, 533.9, 239/505.1–505.12

[56] References Cited

U.S. PATENT DOCUMENTS

| | | | |
|---|---|---|---|
| 3,610,529 | 10/1971 | Huber | 239/533.8 X |
| 3,910,503 | 10/1975 | Barber | 239/533.8 |
| 3,997,117 | 12/1976 | Kohler et al. | 239/533.8 |
| 4,379,524 | 4/1983 | Andrews | 239/533.8 |
| 4,719,889 | 1/1988 | Amann et al. . | |
| 5,464,156 | 11/1995 | Ricco et al. | 239/533.8 X |

FOREIGN PATENT DOCUMENTS

| | | | |
|---|---|---|---|
| 0426205 | 5/1991 | European Pat. Off. . | |
| 2030219 | 4/1980 | United Kingdom | 239/533.8 |
| 2203795 | 10/1988 | United Kingdom | 239/533.8 |

*Primary Examiner*—Kevin Weldon
*Attorney, Agent, or Firm*—Browdy and Neimark

[57] ABSTRACT

This fuel injection device extends the duration which elapses from the injection starting point to the point of maximum lift of the needle valve to lower the initial injection ratio, thereby reducing $NO_x$ emissions. Further, the time which elapses from the starting point of injection termination to the nozzle hole closing point is decreased to ensure positive fuel cutoff, increase the injection rate immediately before the end of the injection process and reduce emissions such as soot and HC. In this fuel injection device, the passage for supplying high-pressure fuel into the balance chamber is formed larger than the orifice for discharging the fuel from the balance chamber, and a normally open check valve is provided in the annular chamber.

5 Claims, 7 Drawing Sheets

FUEL INJECTION DEVICE FOR INTERNAL COMBUSTION ENGINES

BACKGROUND OF THE INVENTION

1. Field of the Invention

The present invention relates to a fuel injection device used on internal combustion engines.

2. Description of the Prior Art

Conventional fuel injection devices for multi-cylinder engines include an injection system (electronic control fuel injection system) that controls the amount of fuel injected and the timing of fuel injection by using electronic circuits, a common injection system (common rail injection system) that distributes fuel from an injection pump to combustion chambers through a common passage, and a pressure accumulation type injection system (accumulator injection system) that distributes fuel from an injection pump to combustion chambers through a common passage and a pressure accumulation chamber. These fuel injection devices themselves do not have a pressure accumulation chamber for temporarily storing fuel from the injection pump and therefore the supply of fuel to the fuel injection devices is performed through a common rail, a common passage that works as a pressure accumulation chamber.

A fuel injection device as shown in FIG. 11 has been known. This fuel injection device has a control sleeve 7 securely fitted in a center through-hole 47 formed in a holder body 1 and also has a control piston 2 of a valve assembly slidably installed in a bore 54 of the control sleeve 7. Formed between the holder body 1 and the control sleeve 7 is an annular chamber 18 that communicates with a high-pressure fuel source such as a common rail through a supply hole 17. In the bore 54 of the control sleeve, a balance chamber 35 is formed between the upper surface of the control piston 2 and the bore top. The lift of the control piston 2 is controlled by applying a fuel pressure in the balance chamber 35 to the control piston. The balance chamber 35 communicates with the annular chamber 18 through an orifice 79 for the supply of high-pressure fuel and also with the outside through a outlet passage 26 and an orifice 25 for the release of the fuel pressure. The orifice 25 is opened and closed by a ball 27 secured to a solenoid valve 10.

An electromagnetic type fuel injection device of the above construction is disclosed, for example, in Japan Patent Laid-Open No. 133296/1993. In this device, a control valve comprises a plunger and a valve disc or valve assembly having an axially extending control chamber connected through a hole to an outlet conduit. The hole opens to a flat surface of the valve assembly, the flat surface being perpendicular to the direction of action of an actuator of the plunger. The plunger has a pad element having a flat surface that engages with the surface of the valve assembly. The other end of the pad may be flat or spherical and engages with a complementary surface at the top end of the actuator. An annular chamber communicating with a fuel source through a fuel supply passage is connected to a hollow portion through a radial hole. A liquid pressure in the hollow portion acts on a sliding rod, i.e., a control piston. The liquid pressure in the hollow portion is released through a hole that is opened or closed by the plunger.

In the fuel injection device such as shown in FIG. 11, before fuel injection is performed, there are two kinds of fuel, one supplied to the fuel passage (not shown) from the fuel source such as a common rail and one supplied to the balance chamber 35. Normally, the high-pressure fuel supplied to the fuel passage generates in a fuel reservoir (not shown) a force or liquid pressure to push up a needle valve, which in turn opens nozzle holes injecting fuel into the combustion chamber. There is, however, a force of a spring that pushes down the needle valve to close the nozzle holes. Further, the fuel, which is supplied through a supply hole 17, an annular chamber 18 and an orifice 79 to the balance chamber 35 formed above the top end surface of the control piston 2, generates in the balance chamber 35 a pressure that pushes down the control piston 2.

In a state prior to fuel injection, the orifice 25 is closed by the ball 27 so that the sum of the fuel pressure in the balance chamber 35 and the force of the spring overcomes the fuel pressure in the fuel reservoir to cause the needle valve to close the nozzle holes. For the needle valve to open the nozzle holes to inject fuel, a solenoid of a solenoid type valve actuation mechanism is energized to pull up a solenoid valve 10 and the ball 27, opening the orifice 25. When the orifice 25 is open, the high-pressure fuel is discharged from the balance chamber 35. If the passage cross section of the orifice 25 is set larger than that of the orifice 79, the amount of fuel discharged from the balance chamber 35 through the orifice 25 is larger than the amount of fuel supplied into the balance chamber 35 through the orifice 79, thereby reducing the fuel pressure in the balance chamber 35. Then, the force pushing up the needle valve becomes greater than the force pushing it down, allowing the fuel to be injected into the combustion chamber.

FIG. 10 shows injection characteristics of the fuel injection device. In the figure, the abscissa represents an injection time and the ordinate represents a lift of the needle valve, i.e., an injection rate. From the standpoint of combustion and combustion noise, the relation between the injection time and the injection rate of the fuel injection device should preferably follow a line A, the characteristic that begins with point a when the needle valve opens the nozzle holes and then passes through point c when the needle valve reaches the maximum lift Lmax, point d when the orifice 25 is closed, and point f when the needle valve closes the nozzle holes.

With the conventional fuel injection device, however, the orifice 79 has a smaller passage cross section than the orifice 25 because to reduce the fuel pressure in the balance chamber 35 by opening the orifice 25 requires the amount of fuel discharged through the orifice 25 to be greater than the amount of high-pressure fuel coming into the balance chamber 35 through the orifice 79. For this reason, when the orifice 25 is opened to let the needle valve open the nozzle holes starting the injection (point a), the high-pressure fuel from the orifice 79 flows into the outlet passage 26, pulling up the top surface of the control piston 2, which in turn shortens the time it takes for the needle valve to reach the maximum lift Lmax (point b). Then, when the orifice 25 is closed by the ball 27 (point d), the high-pressure fuel flows into the balance chamber 35 from the orifice 79. Because the passage cross section of the orifice 79 is small, it takes time for the fuel pressure acting on the top surface of the control piston 2 to rise, delaying the reduction to zero of the needle valve lift and the closure of the nozzle holes (nozzle closing point g).

As described above, if the time from the injection starting point a to the maximum lift point b becomes short and the time from the closing point d to the nozzle hole closing point g becomes long, the initial injection rate increase and the injection rate immediately before the end of the injection decreases. This in turn increases a delay in combustion in the combustion chamber, increasing NOx emissions and combustion noise. Another problem of the conventional fuel injection device is that because the injection rate near the end of the injection is low, the fuel is sprayed in droplets not atomized particles, increasing soot, HC emissions and deteriorating fuel efficiency.

SUMMARY OF THE INVENTION

The object of this invention is to provide a fuel injection device for internal combustion engines, of a type that supplies fuel through a common rail or a common fuel passage, in which a valve assembly comprising a needle valve and a control piston, both reciprocating in a main body made up of a holder body and a nozzle body, is lifted according to the fuel pressure in a balance chamber; in which a supply passage for supplying the high-pressure fuel into the balance chamber is made larger in cross section than an exhaust passage for discharging the fuel from the balance chamber; and in which a normally open check valve is provided in the supply passage to extend the period that elapses from an injection starting point when the needle valve opens nozzle holes to a needle valve maximum lift point thereby lowering the initial injection rate and to shorten the period from an exhaust passage closing point to a nozzle hole closing point thereby raising the injection rate immediately before the end of the injection operation to improve the combustion characteristics and reduce the combustion noise.

This invention relates to a fuel injection device for internal combustion engines which comprises: a valve assembly having a needle valve and a control piston connected to the needle valve, both reciprocating in the main body, the main body having nozzle holes to inject fuel; a fuel chamber formed in the main body around the valve assembly; a balance chamber formed in a control sleeve fixed in the main body to control a lift of the valve assembly by applying a fuel pressure to the upper surface of the valve assembly; an annular chamber formed in the main body and communicating with a high-pressure fuel source to supply the high-pressure fuel to the balance chamber through a supply passage; an exhaust passage having an orifice to release the fuel pressure from the balance chamber; an actuator to drive a control valve to open and close the exhaust passage; and a normally open check valve provided in the annular chamber and urged at all times by a spring force in a direction that opens the supply passage; wherein the supply passage is formed larger in passage cross section than the exhaust passage.

The normally open check valve comprises a split ring disposed in the annular chamber and formed with a slit that produces a spring force in a diameter expansion direction, an open-close valve secured to the split ring and adapted to open the supply passage by a spring force and close the supply passage by a fuel pressure greater than the spring force, and a positioning means to position the split ring on the control sleeve.

Or, the normally open check valve comprises a split ring disposed in the annular chamber and formed with a slit that produces a spring force in a diameter expansion direction, an open-close valve secured to the split ring and adapted to open the supply passage by a spring force and close the supply passage by a fuel pressure greater than the spring force, and a positioning means to position the split ring on the control sleeve; and wherein the open-close valve is formed with an annular groove in which a notch edge formed in the slit of the split ring is fitted.

Alternatively, the normally open check valve comprises a split ring disposed in the annular chamber, an open-close valve seated on a seat surface formed in the split ring by the force of a spring disposed in the supply passage, the open-close valve being adapted to open the supply passage by the spring force and close the supply passage by a fuel pressure greater than the spring force, and a positioning means to position the split ring on the control sleeve.

Or, the normally open check valve comprises a split ring having an opened portion and disposed in the annular chamber, an open-close valve having a leaf spring secured to the ends of the split ring on both sides of the opened portion, the leaf spring being adapted to open the supply passage by a spring force and close the supply passage by a fuel pressure greater than the spring force, and a positioning means to position the split ring on the control sleeve.

In this fuel injection device, because the supply passage for supplying the high-pressure fuel into the balance chamber is formed larger in cross section than the exhaust passage for releasing the fuel from the exhaust chamber and the normally open check valve is provided in the supply passage, it is possible to extend the period that elapses from the injection starting point when the needle valve opens the nozzle holes to the needle valve maximum lift point thereby lowering the initial injection rate and to shorten the period from the exhaust passage closing point to the nozzle hole closing point thereby raising the injection rate immediately before the end of the injection operation. This ensures ideal injection characteristics thereby improving combustion characteristics and reducing combustion noise.

That is, the application of this fuel injection device to internal combustion engines reduces the initial injection rate, which in turn limits the precombustion ratio and reduces NOx emissions. Further, because the time which elapses from the exhaust passage closing point to the nozzle hole closing point is decreased, the injection rate immediately before the end of the injection process can be increased resulting in positive fuel cutoff and reduced emissions of particulates such as carbon, soot and HC. This in turn reduces smoke. Moreover, the normally open check valve can be incorporated in the annular chamber easily, reducing the manufacture cost without deteriorating the assembly performance.

DETAILED DESCRIPTION OF THE PREFERRED EMBODIMENTS

Figure 1:
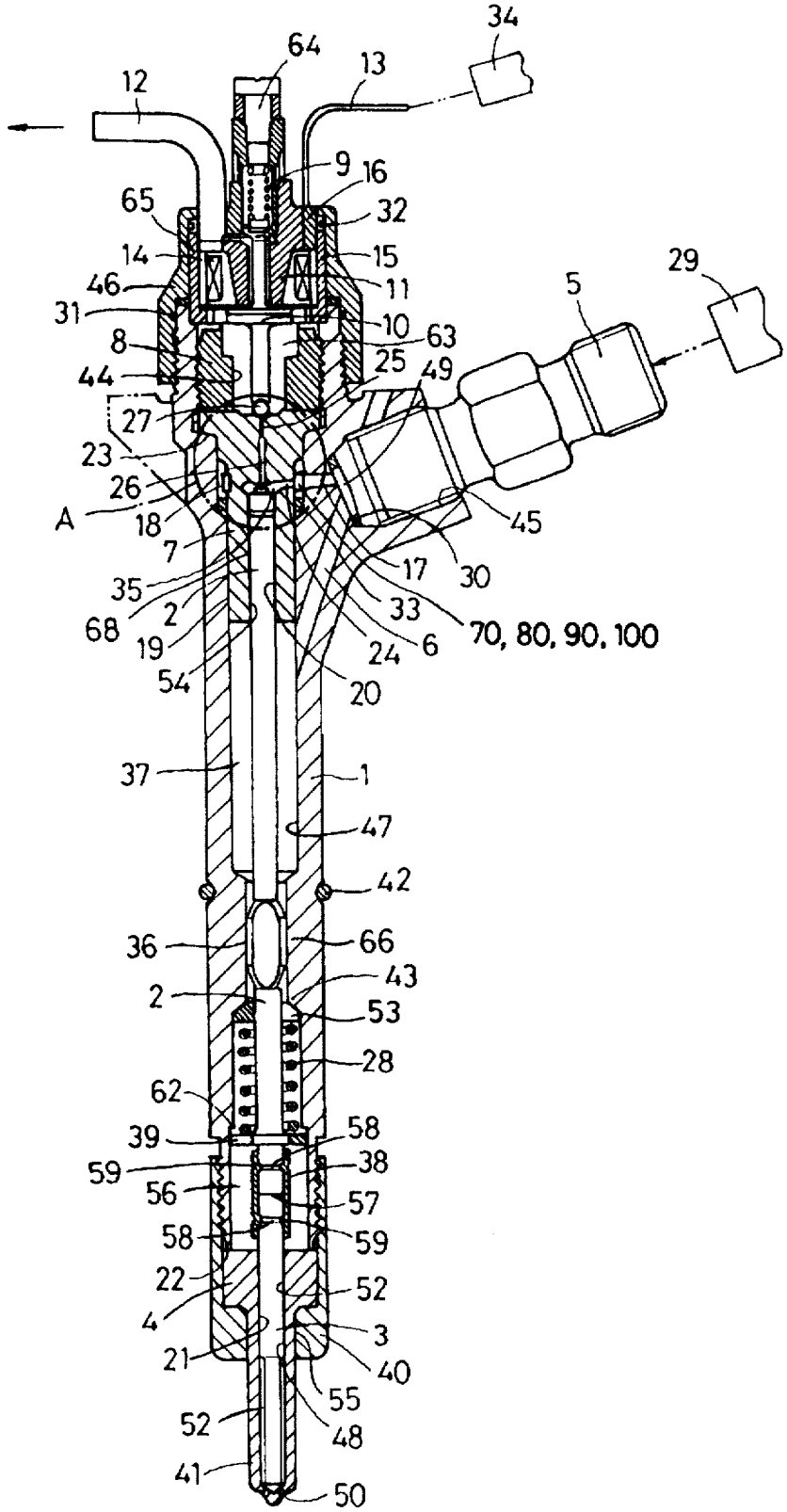
FIG. 1 is a cross section of the fuel injection device as one embodiment of this invention.

Embodiments of the fuel injection device according to this invention will now be described by referring to the accompanying drawings. In the drawings, components having identical structures and functions are assigned like reference numerals, and repetitive explanations are omitted. First, with reference to FIG. 1, one embodiment of the fuel injection device according to this invention is detailed.

This fuel injection device is applied to a common rail injection system and an accumulator injection system, which, though not shown, inject into each of combustion chambers of an internal combustion engine a high-pressure fuel that was supplied from an injection pump through a common passage or pressure accumulation chamber (hereinafter referred to as a common rail 29). A holder body 1 in this fuel injection device is sealingly installed in a hole (not shown) provided in a base such as a cylinder head through a sealing member 42. The lower end portion of the holder body 1 is securely fitted with a nozzle body 4 by screwing a sleeve nut 40 over a threaded portion of the holder body 1. The lower end surface of the holder body 1 and the upper end surface of the nozzle body 4 form interface surfaces 22 that constitute sealing surfaces. The outer circumferential surface of the nozzle body 4 is formed large in diameter at the upper part and small at the lower part. The sleeve nut 40 engages with a stepped surface 55 formed at the lower part of the nozzle body 4 and is screwed over the threaded portion of the holder body 1.

The upper part of the holder body 1 has a plug mounting hole 45 for mounting a threaded fuel inlet plug 5, which is screwed into the plug mounting hole 45. The upper end portion of the holder body 1 is securely fitted with a solenoid type valve actuation mechanism 65, which reciprocates a valve assembly, by screwing a sleeve nut 46 over a threaded portion of the holder body 1. Sealing between the sleeve nut 46 and the solenoid type valve actuation mechanism 65 as well as the holder body 1 is provided by sealing members 31, 32. A fuel from the common rail 29, a high-pressure fuel source, is supplied into the fuel injection device through the fuel inlet plug 5. In this fuel injection device, electric currents of drive signals from a control unit 34 are supplied through a connector or harness 13 and a terminal 16 to the solenoid type valve actuation mechanism 65. The solenoid type valve actuation mechanism 65 constitutes an actuator (coil 14, solenoid 11, solenoid valve 10 and ball 27 all described later) that discharges a fuel pressure acting on the valve assembly through an exhaust passage (outlet passage 26, orifice 25, hollow chamber 63 and fuel return pipe 12 all described later).

The fuel inlet plug 5 is screwed into the plug mounting hole 45 in the holder body 1. Sealing between the holder body 1 and the fuel inlet plug 5 is achieved by a seal member 30. The holder body 1 is formed with a center through-hole 47, through which a valve assembly is passed, and also with a supply hole 6 that allows communication between the center through-hole 47 and a fuel inlet 49 of the fuel inlet plug 5. At virtually the center of the center through-hole 47 of the holder body 1 is formed a diameter-constricted guide portion 66, which has a guide surface 36 and through which a control piston 2 of the valve assembly is slidably passed. The center through-hole 47 of the holder body 1 forms a fuel chamber 37 for storing a fuel around the control piston 2 that passes through the center through-hole 47 of the holder body 1. The nozzle body 4 has a center through-hole 48 that communicates with the center through-hole 47 and through which a needle valve 3 of the valve assembly is passed. The nozzle body 4 is also formed with nozzle holes 50 to inject fuel into the combustion chamber (not shown).

The valve assembly, as described above, has the control piston 2 and the needle valve 3 connected together by a coupling means 38. The control piston 2 and the needle valve 3 abut against each other at their engagement surfaces 57 and are axially held together by the coupling means 38 that has a spring force to allow axis deviation between them in a direction perpendicular to the axial direction. The control piston 2 has an annular groove 58 formed at the lower end portion thereof and the needle valve 3 is formed with an annular groove 58 at the upper end portion thereof. The coupling means 38 has inwardly projecting beads 59 at both ends that form locking portions. The coupling means 38 is fitted over the facing end portions of the needle valve 3 and the control piston 2, with the beads 59 of the coupling means 38 fitted in the annular groove 58 of the control piston 2 and the annular groove 58 of the needle valve 3.

In the region where the control piston 2 and the needle valve 3 are connected by the coupling means 38, a fuel chamber 56 communicating with the fuel chamber 37 is formed. The control piston 2 and the needle valve 3 contact each other at their engagement end surfaces 57 and are axially held together by the coupling member 38 that has an elasticity to allow axis deviation between them in a direction perpendicular to the axial direction. The needle valve 3 is slidably inserted in the center through-hole 48 of the nozzle body 4 with a clearance 52 formed therebetween and with the face of its front end portion 41 seated on a seat surface of the nozzle body 4 that is formed with the nozzle holes 50. The clearance 52 formed around the needle valve 3 constitutes a passage for a high-pressure fuel. Between the center through-hole 48 of the nozzle body 4 and the circumferential surface of the needle valve 3 there is formed a sliding surface 21 having the clearance 52. The fuel pressure acting on the tapered surface of the front end portion of the needle valve 3, seated on the nozzle holes 50 of the nozzle body 4 to open and close the nozzle holes 50, works to raise the valve assembly.

A control sleeve 7 is fitted in the center through-hole 47 of the holder body 1 and forms an engagement surface 19 that serves as seal. A shoulder portion of the control sleeve 7 engages with an upper stepped portion of the center through-hole 47 to form an abutment sealing surface 23. An annular chamber 18 is formed between the outer circumferential surface of the control sleeve 7 and the center through-hole 47 of the holder body 1. The control sleeve 7 is held immovable by a fixing plug 8 having a hole 44 therein which is screwed into the threaded part of the upper end portion of the holder body 1. A complete sealing between the holder body 1 and the control sleeve 7 is achieved by a sealing member 33. The annular chamber 18 communicates with the fuel inlet 49 through a fuel supply hole 17 formed in the holder body 1. The annular chamber 18 has installed therein, in particular, a normally open check valve 70, 80, 90 or 100 described later.

A bore 54 in the control sleeve 7 opening downwardly has a sliding surface 20 that slidably receives a control piston 2 in such a way as to allow the high-pressure fuel to move in a clearance 68 formed between the sliding surface 20 and the control piston 2. At the top of the bore 58 there is formed a balance chamber 35 between the bore top and the upper surface of the control piston 2. Further, the control sleeve 7 has an inlet passage 24 constituting a fuel supply passage that connects the balance chamber 35 with the annular chamber 18, and also has an orifice 25 and a outlet passage 26 together forming an exhaust passage that communicates with the upper surface of the control sleeve 7. The balance chamber 35 is connected to the annular chamber 18 through the inlet passage 24 and the normally open check valve 70, 80, 90, 100. The balance chamber 35 has a function of controlling the lift of the control piston 2 by applying the fuel pressure to the upper surface of the control piston 2. The fuel pressure in the fuel chamber 37 is so set that the total pressure acting on the control piston 2 is zero.

In the solenoid type valve actuation mechanism 65, the fixing plug 8 for fixing the control sleeve 7 in the holder body 1 has an inside space or top chamber 63 therein, in which is installed a ball 27 that opens and closes the outlet of the orifice 25. The ball 27 is secured to and integrally formed with the lower end of a solenoid valve 10 that is moved up and down by the energization of a solenoid 11. The solenoid 11 is secured to the holder body 1 by the sleeve nut 46 through a solenoid support member 15. A coil 14 is arranged around the outer circumferential surface of the solenoid 11. On the top of the solenoid 11 is installed a solenoid valve spring 9, which is set to the solenoid 11 by a set screw 64. The coil 14 is supplied, through the terminal 16 and connector (harness) 13, with an electric current corresponding to a signal from the control unit 34. The electricity to the coil 14 energizes the solenoid 11, which in turn pulls up the solenoid valve 10 against the force of the solenoid valve spring 9.

On the top of the solenoid type valve actuation mechanism 65 is arranged a fuel return pipe 12 extending from the sleeve nut 46. The fuel return pipe 12 communicates with the top chamber 63 through a passage formed around the solenoid 11. Hence, when the ball 27 integral with the solenoid valve 10 opens the orifice 25, the high-pressure fuel in the balance chamber 35 is discharged through the outlet passage 26, orifice 25 and top chamber 63 and to the fuel return pipe 12. That is, when the solenoid type valve actuation mechanism 65 that constitutes an actuator is operated, the solenoid valve 10 and the ball 27, both forming the control valve, opens the orifice 25 allowing the fuel pressure in the balance chamber 35 to be discharged through the outlet passage 26, orifice 25, top chamber 63 and fuel return pipe 12, all constituting the exhaust passage.

The return action of the needle valve 3 to close the nozzle holes 50 is achieved by a return spring 28 disposed between a retainer 39 secured to the lower part of the control piston 2 and a retainer 53 engaged and fixed to a stepped portion 43 in the center through-hole 47 of the holder body 1. The retainer 39 secured to the lower part of the control piston 2 is located at a position corresponding to a large-diameter portion below a stepped portion 62 of the center through-hole 47 of the holder body 1.

Figure 10:
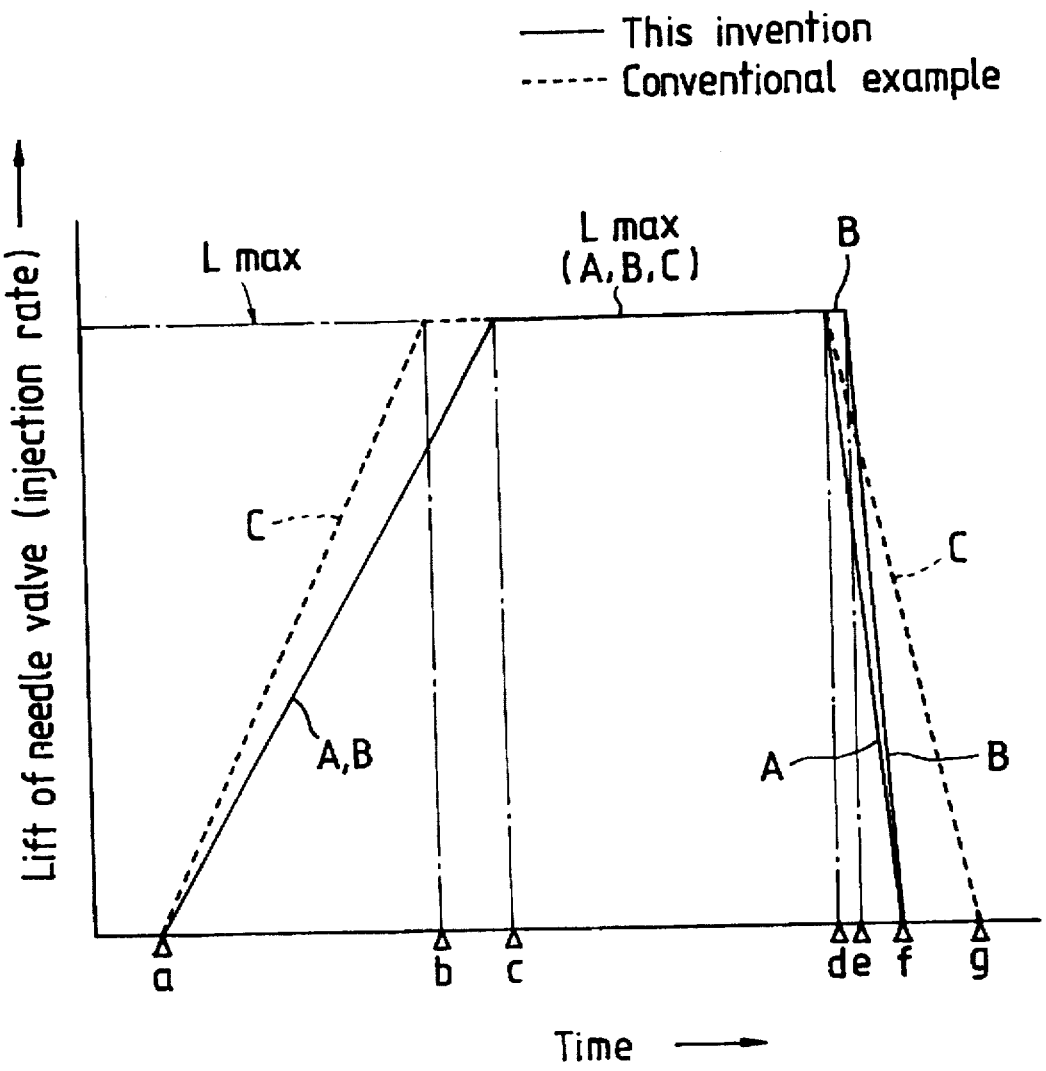
FIG. 10 is a characteristic diagram showing the relation between the injection time and the lift of the needle valve in the fuel injection device.
Figure 11:
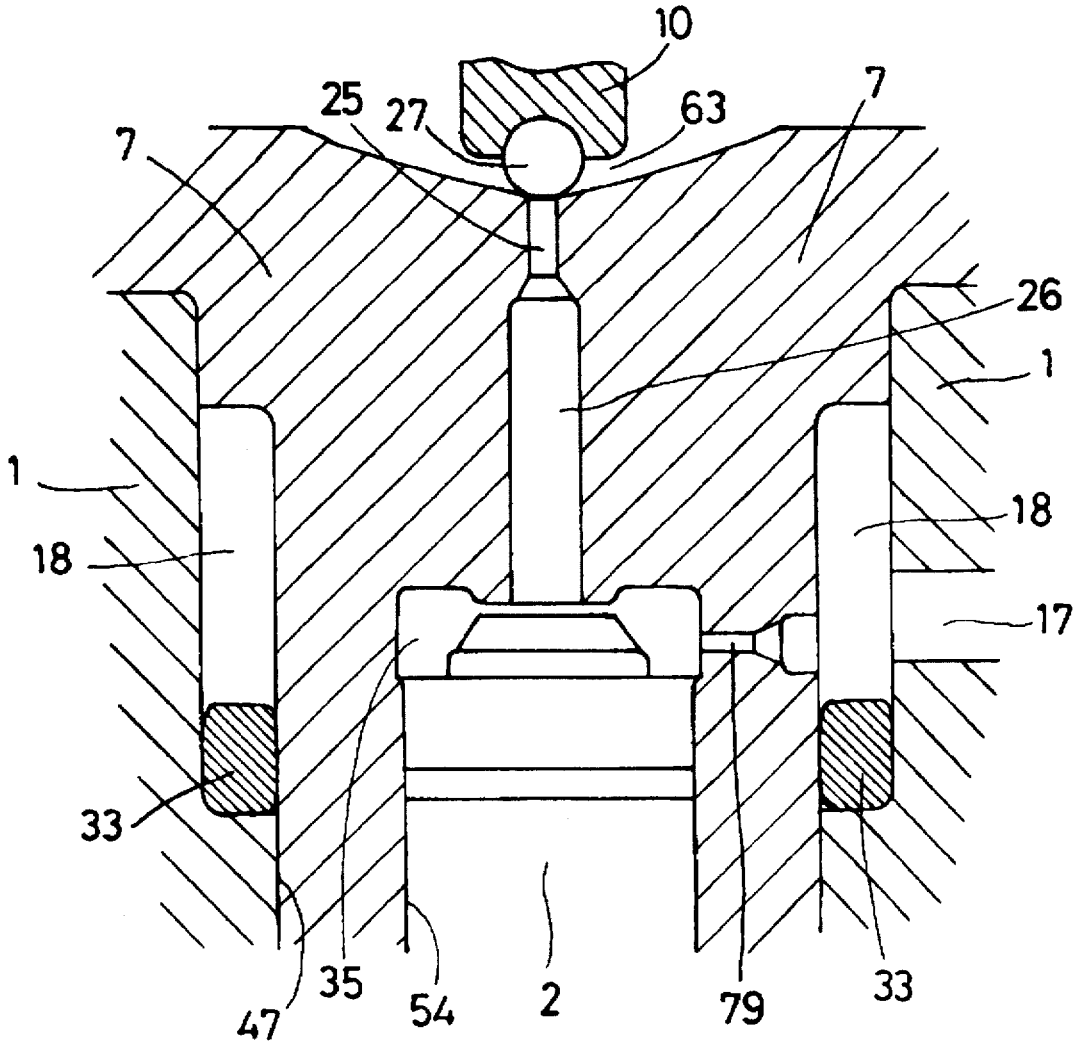
FIG. 11 (PRIOR ART)
FIG. 11 is a cross section showing an essential portion of a conventional fuel injection device.

The fuel injection device of this invention is characterized in that the cross section of the inlet passage 24 forming the fuel supply passage is set larger than that of the orifice 25 forming the exhaust passage and that a normally open check valve 70, 80, 90, 100 is installed in the annular chamber 18 upstream of the inlet passage 24. With this construction, the fuel injection device can produce a fuel injection characteristic represented by a solid line B in FIG. 10.

Figure 2:
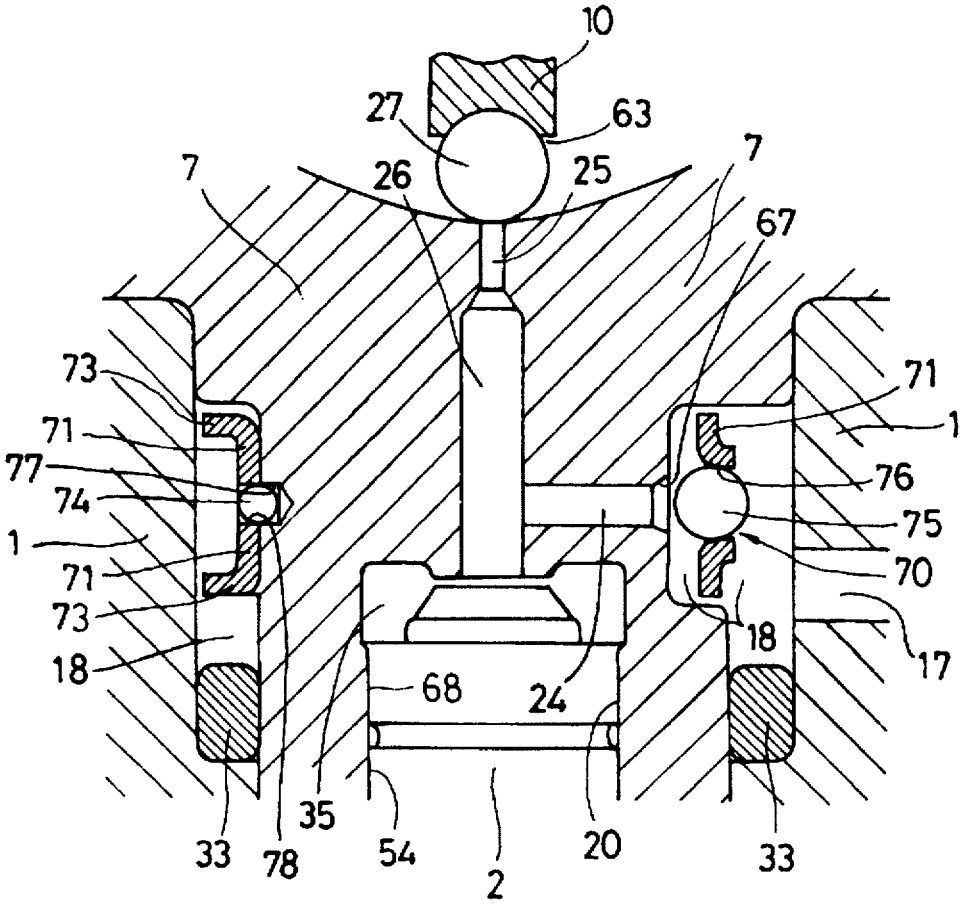
FIG. 2 is a cross section showing one embodiment of an essential portion of the fuel injection device of FIG. 1.
Figure 3:
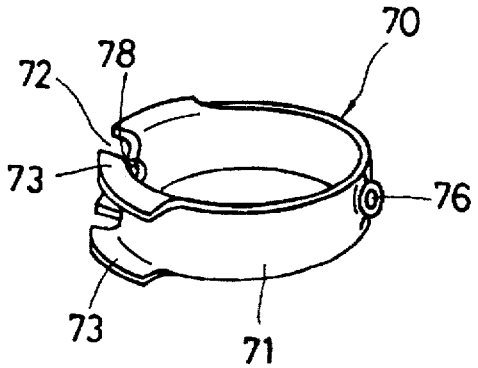
FIG. 3 is a perspective view showing a normally open check valve in the fuel injection device of FIG. 2.

Now, by referring to FIG. 2 and 3, the normally open check valve 70 applied to this fuel injection device is described. The inlet passage 24 is connected to the outlet passage 26 that communicates with the balance chamber 35. The normally open check valve 70 installed in the annular chamber 18 upstream of the inlet passage 24 comprises a split ring 71 made of a leaf spring, whose opposite ends face close each other at a slit 72 producing a spring force in a diameter expansion direction; a ball-like open-close valve 75 fitted in and secured to a notched portion 76 formed on the side opposite to the slit 72 of the split ring 71; and a positioning means to position the split ring 71 on the control sleeve 7. The open-close valve 75 normally opens the inlet passage 24 that forms the fuel supply passage and, in a fuel pressure unbalanced state in which the pressure in the outlet passage 26 lowers, closes the inlet passages 24 against the spring force of the split ring 71. That is, when the solenoid type valve actuation mechanism 65 operates to cause the ball 27 to open the orifice 25, the pressure in the balance chamber 35 and the outlet passage 26 lowers. At this time, the open-close valve 75 is seated on a seat surface 67 of the inlet passage 24 against the spring force of the split ring 71, thus closing the inlet passage 24. The positioning means comprises a ball 74 fitted in a hole 78 formed in the split ring 71, and engages in a recessed portion 77 formed in the control sleeve 7 to achieve the circumferential positioning. The split ring 71 has flanges 73 on both sides (on the upper and lower sides) of the slit 72. The flange 73 prevent the split ring 71 from moving in the radial direction because of its spring force when the open-close valve 75 closes the inlet passage 24, by abutting against the wall of the holder body 1.

The fuel injection device of this invention with the above construction operates as follows. In this fuel injection device, the solenoid type valve actuation mechanism 65 is not energized, and the solenoid valve 10 and the ball 27 are pushed down by the force of the solenoid valve spring 9, with the orifice 25 closed by the ball 27. In this state the high-pressure fuel from the common rail 29 is supplied to the fuel inlet 49 through the fuel inlet plug 5. The fuel chamber 37 formed around the control piston 2 and the needle valve 3 is filled with the high-pressure fuel supplied from the fuel inlet 49 through the supply hole 6. The clearance 52 formed between the outer circumference of the needle valve 3 and the nozzle body 4 is filled with the high-pressure fuel. The annular chamber 18 is supplied with the high-pressure fuel from the fuel inlet 49 through the supply hole 17, and the balance chamber 35 is filled with the high-pressure fuel from the annular chamber 18 through the normally open check valve 70 and the orifice 24. The high-pressure fuel in the fuel chamber 37 is sealed by the sealing members 30, 33. The high-pressure fuels in the annular chamber 18 and the balance chamber 35, which communicate with each other through the inlet passage 24, are isolated from the high-pressure fuel in the fuel chamber 37 by the sealing member 33.

When the orifice 25 is closed by the solenoid valve 10 and ball 27, the high-pressure fuel in the balance chamber 35 that was supplied through the supply hole 17 and the orifice 24 acts on the upper surface of the control piston 2 as a downward force. The force of the return spring 28 acts on the valve assembly to push it down. The fuel pressure acting on the tapered surface of the front end portion of the needle valve 3, seated on the nozzle holes 50 of the nozzle body 4 to open and close the nozzle holes 50, works to raise the valve assembly. In other words, the valve assembly comprising the control piston 2 and the needle valve 3 is so constructed that it is raised by the fuel pressure acting on it to open the nozzle holes 50. In this embodiment, the fuel pressure acting on the tapered surface of the front portion of the needle valve 3, which comes into or out of contact with nozzle holes 50 of the nozzle body 4 to close and open the nozzle holes 50, becomes greater than the sum of the spring force of the return spring 28 and the fuel pressure in the balance chamber 35 acting on the upper surface of the control piston 2, with the result that the valve assembly is moved upward. Further, the total downward force, i.e., the pressure acting on the control piston 2 in the balance chamber 35 and the force of the return spring 28 combined, is set larger than the upward force acting on the tapered surface of the front end of the needle valve 3, so that the needle valve 3 closes the nozzle holes 50.

Under this condition, when a signal from the control unit 34 supplies electricity to the coil 14 of the solenoid type valve actuation mechanism 65, the solenoid 11 produces an electromagnetic force and lifts the solenoid valve 10 and the ball 27, opening the orifice 25. Once the orifice 25 is open, the high-pressure fuel in the balance chamber 35 is discharged through the outlet passage 26 and the orifice 25 into the top chamber 63, from which it is returned to the fuel tank through the fuel return pipe 12. With the high-pressure fuel in the balance chamber 35 exhausted, the upward force acting on the tapered surface of the front end of the needle valve 3 overcomes the force of the return spring 28, causing the needle valve 3 that is axially secured to the control piston 2 to move up, opening the nozzle holes 50, through which the fuel begins to be injected into the combustion chamber (not shown). It is noted here that the inlet passage 24 is formed larger than the orifice 25 and this produces the following effect. When the fuel pressure in the outlet passage 26 lowers, the open-close valve 75 of the normally open check valve 70 engages the seat surface 67 against the spring force of the split ring 71 to close the inlet passage 24, almost blocking the inflow of the high-pressure fuel from the annular chamber 18 into the inlet passage 24. As a result, the flow of the high-pressure fuel from the annular chamber 18 to the outlet passage 26 ceases, no longer generating a force that pulls up the control piston 2. The injection ratio characteristic therefore follows the solid line B in FIG. 10, in which the time that elapses from the injection starting point a to the maximum lift point c where the maximum lift Lmax of the needle valve 3 is reached becomes longer than in the conventional device.

Next, when a signal from the control unit 34 deenergizes the coil 14 of the solenoid type valve actuation mechanism 65, the electromagnetic force of the solenoid 11 collapses, allowing the solenoid valve 10 and the ball 27 to move down by the force of the solenoid valve spring 9, closing the orifice 25 with the ball 27 (the orifice closing point d). When the orifice 25 is closed, the high-pressure fuel in the chamber 37 flows up through the clearance 68 formed between the outer circumferential surface of the control piston 2 and the sliding surface 20 of the bore 54 in the control sleeve 7 and into the balance chamber 35 and at the same time the open-close valve 75 of the normally open check valve 70 instantaneously parts from the seat surface 67 to form a clearance, through which the high-pressure fuel in the annular chamber 18 flows into the inlet passage 24, the outlet passage 26 and the balance chamber 35, raising the pressure in the balance chamber 35. Then, the sum of the pressure in the balance chamber 35 and the spring force of the split ring 71 balances with the pressure in the annular chamber 18, at which time the normally open check valve 70 opens the inlet passage 24 (point e when the normally open check valve is opened). During the period from the orifice closing point d to the normally open check valve opening point e, the needle valve 3 does not slide down but remains in the lifted position. This period represents the delay time by which the nozzle hole closing operation of the needle valve 3 lags the closure of the orifice 25.

When the normally open check valve 70 opens the inlet passage 24, the high-pressure fuel from the common rail 29 is supplied into the balance chamber 35 through the fuel inlet 49, the supply hole 17, the annular chamber 18 and the inlet passage 24. Because the passage cross section of the inlet passage 24 is formed large, the high-pressure fuel in the annular chamber 18 is admitted through the inlet passage 24 into the balance chamber 35 in a short time. The fuel pressure in the balance chamber 35 acts on the upper surface of the control piston 2. This fuel pressure in combination with the force of the return spring 28 causes the control piston 2 and the needle valve 3 to move down together. The pressure in the balance chamber 35 and the pressure in the annular chamber 18 become equal, and the lift of the needle valve decreases to zero, closing the nozzle holes 50 (nozzle hole closing point f) and terminating the fuel injection from the nozzle holes 50. This fuel injection device repeats the above operation to inject fuel into the combustion chamber intermittently.

Figure 4:
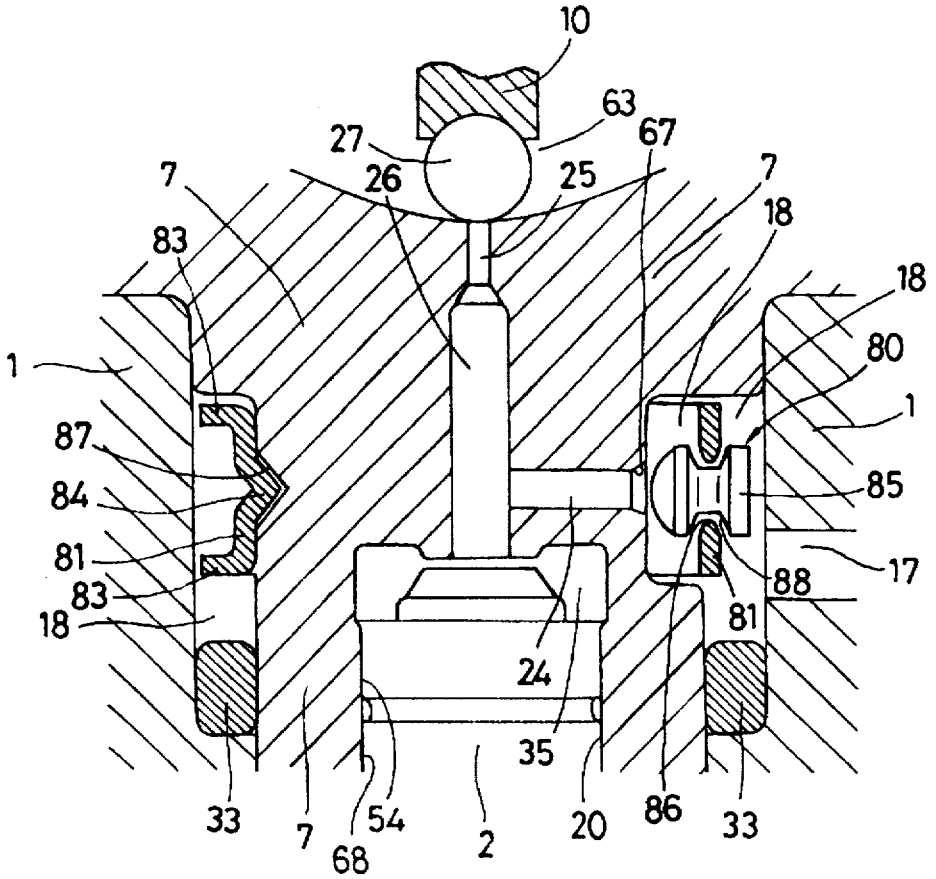
FIG. 4 is a cross section showing another embodiment of the essential portion of the fuel injection device of FIG. 1.
Figure 5:
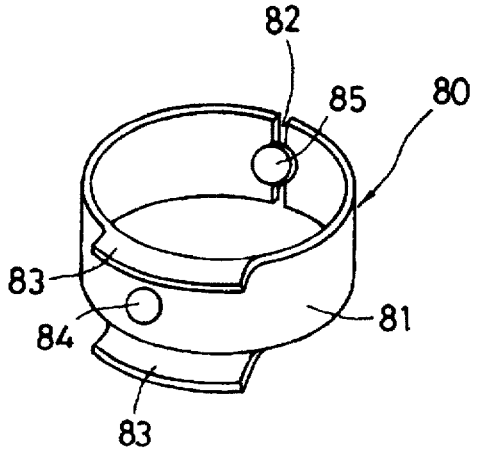
FIG. 5 is a perspective view showing a normally open check valve in the fuel injection device of FIG. 4.

Next, by referring to FIGS. 4 and 5 another embodiment of the fuel injection device is described. This fuel injection device is identical in construction with the first embodiment, except that it has a different structure of the normally open check valve. In this embodiment, the normally open check valve comprises a split ring 81 installed in the annular chamber 18 and made of a leaf spring, whose opposite ends face close each other at a slit 82 producing a spring force in a diameter expansion direction; an open-close valve 85 fixed in the split ring 81 which makes up the fuel supply passage; and a positioning means to position the split ring 81 on the control sleeve 7. A notch edge portion 86 formed in the slit 82 of the split ring 81 fits in an annular groove 88 formed in the open-close valve 85. The mechanism of the open-close valve 85 is similar to the open-close valve 75 of the first embodiment. The positioning means has an inwardly projecting portion 84 formed on the split ring 81. The circumferential positioning of the split ring 81 is achieved by the projecting portion 84 engaging in a recessed portion 87 formed in the control sleeve 7. The split ring 81 has flanges 83 formed on a side diametrically opposite to where the slit 82 is located. The flanges 83 abut against the wall surface of the holder body 1 when the open-close valve 85 closes the inlet passage 24, to prevent the split ring 81 from moving in the radial direction due to its spring force.

Figure 6:
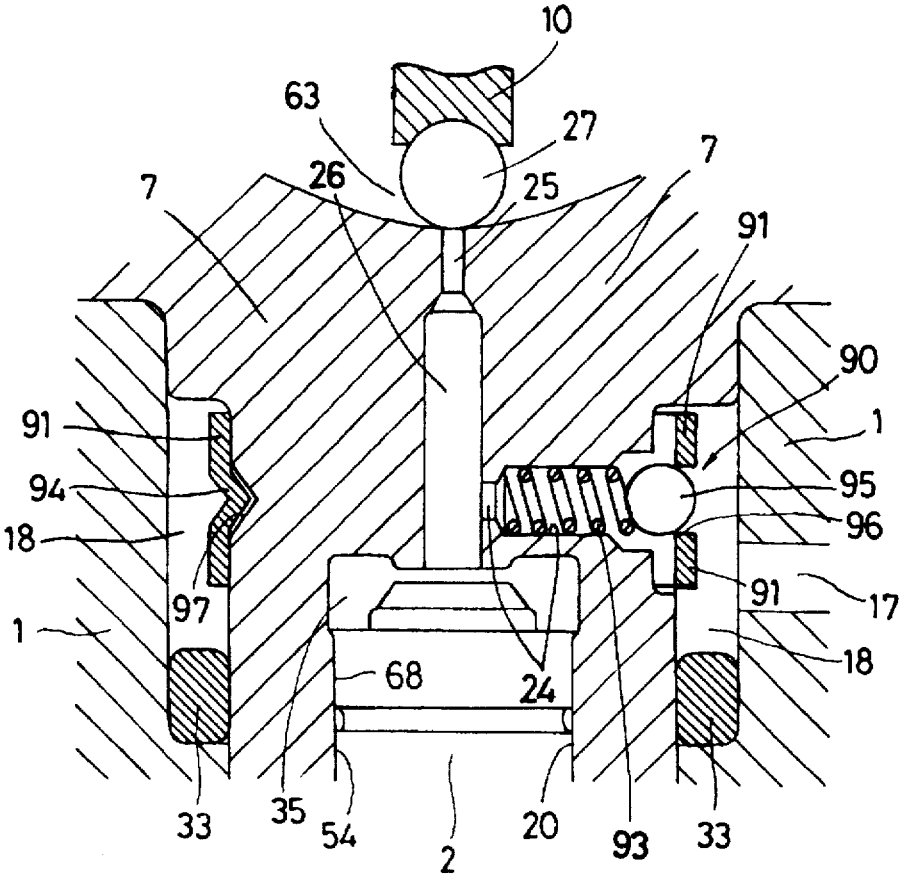
FIG. 6 is a cross section showing still another embodiment of the essential portion of the fuel injection device of FIG. 1.
Figure 7:
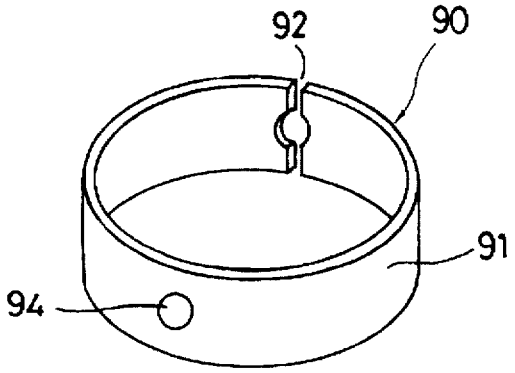
FIG. 7 is a perspective view showing a normally open check valve in the fuel injection device of FIG. 6.

Next, by referring to FIGS. 6 and 7, a still another embodiment of this fuel injection device will be described. This embodiment has an identical construction to the previous embodiments, except in the structure of the connecting member. In this embodiment, a normally open check valve 90 comprises a split ring 91 installed in the annular chamber 18; an open-close valve 95 that engages with a seat surface 96 formed in the split ring 91 by the force of a spring 93 installed in the inlet passage 24; and a positioning means to position the split ring 91 on the control sleeve 7. The mechanism of the open-close valve 95 is similar to the open-close valves 75, 85 of the preceding embodiments. The positioning means includes an inwardly projecting portion 94 formed in the split ring 91. The circumferential positioning of the split ring 91 is accomplished by the projecting portion 94 engaging in a recessed portion 97 formed in the control sleeve 7.

Figure 8:
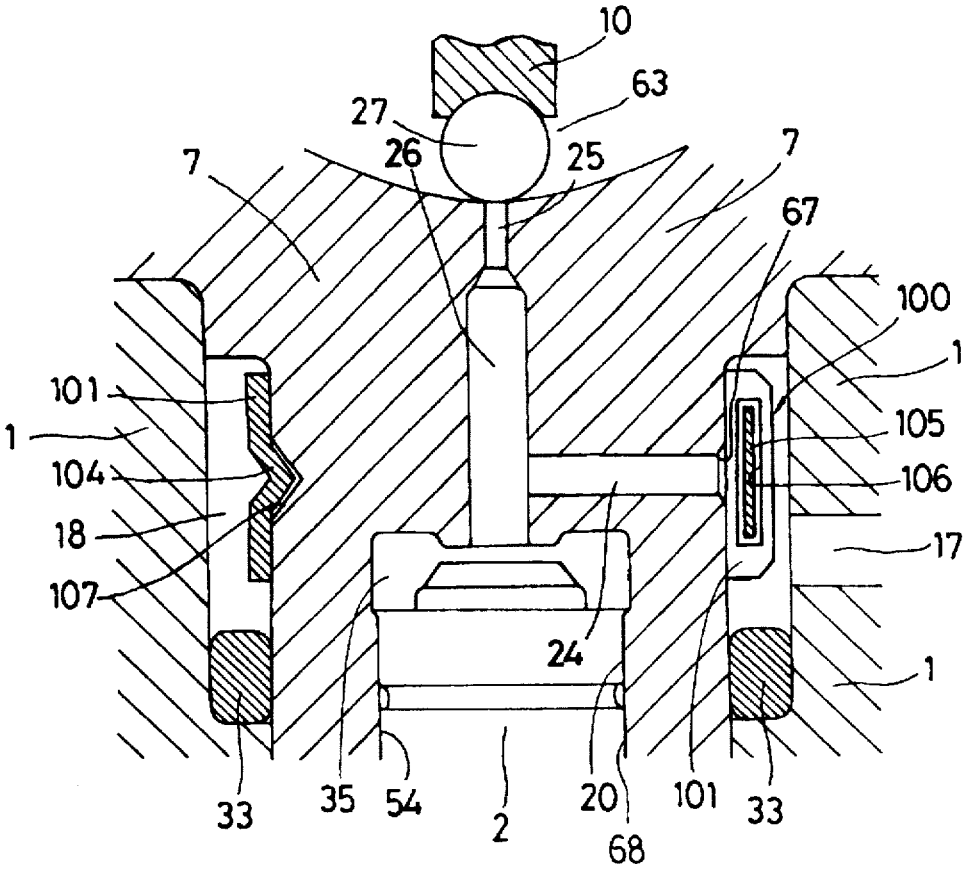
FIG. 8 is a cross section showing a further embodiment of the essential portion of the fuel injection device of FIG. 1.
Figure 9:
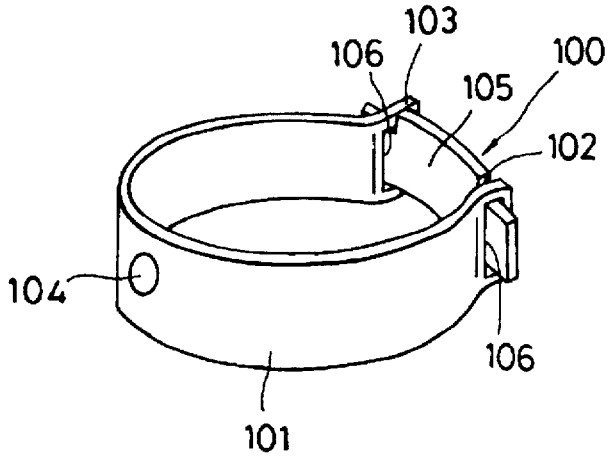
FIG. 9 is a perspective view showing a normally open check valve in the fuel injection device of FIG. 8.

Next, with reference to FIGS. 8 and 9, a further embodiment of the fuel injection device is explained. This embodiment has the same construction as the preceding embodiment except in the structure of the connecting means. In this embodiment, a normally open check valve 100 comprises a split ring 101 installed in the annular chamber 18 and having an opened portion 102; an open-close valve 105 made of a leaf spring that is attached to the ends of the opened portion 102 of the split ring 101 and which opens and closes the inlet passage 24 by its spring force; and a positioning means to position the split ring 101 on the control sleeve 7. The mechanism of the open-close valve 105 is similar to the open-close valves 75, 85, 95 of the previous embodiments. That is, the open-close valve 105, when deformed by the fuel pressure against its spring force, engages with the seat surface 67 of the inlet passage 24 thereby closing the inlet passage 24. The positioning means includes an inwardly projecting portion 104 formed on the split ring 101. The circumferential positioning of the split ring 101 is accomplished by the projecting portion 104 fitting into a recessed portion 107 formed in the control sleeve 7. The open-close valve 105 is mounted to the split ring 101 by having its ends inserted through holes 106 formed at the ends 103 of the split ring 101, the ends 103 defining the opened portion 102.

What is claimed is:

1. A fuel injection device for internal combustion engines comprising:

a main body having nozzle holes to inject fuel;

a valve assembly having a needle valve and a control piston connected to the needle valve, body reciprocating in the main body;

a fuel chamber formed in the main body around the valve assembly;

a balance chamber formed in a control sleeve fixed in the main body to control a lift of the valve assembly by applying a fuel pressure to the control piston;

an annular chamber formed in the main body and communicating with a high-pressure fuel source;

a supply passage communicating with the annular chamber to supply the high-pressure fuel to the balance chamber;

an exhaust passage having an orifice to release the fuel from the balance chamber;

an actuator to drive a control valve to open and close the exhaust passage; and a normally open check valve provided in the annular chamber and urged at all times by a spring force in a direction that opens the supply passage;

wherein the supply passage has a greater passage cross section than that of the orifice of the exhaust passage.

2. A fuel injection device for internal combustion engines according to claim 1, wherein the normally open check valve comprises a split ring disposed in the annular chamber and formed with a slit that produces a spring force in a diameter expansion direction, an open-close valve secured to the split ring and adapted to open the supply passage by a spring force and to close the supply passage by a fuel pressure greater than the spring force, and a positioning means to position the split ring on the control sleeve.

3. A fuel injection device for internal combustion engines according to claim 1, wherein the normally open check comprises a split ring disposed in the annular chamber and formed with a slit that produces a spring force in a diameter expansion direction, an open-close valve secured to the split ring and adapted to open the supply passage by a spring force and to close the supply passage by a fuel pressure greater than the spring force, and a positioning means to position the split ring on the control sleeve; and wherein the open-close valve is formed with an annular groove in which a notch edge formed in the slit of the split ring is fitted.

4. A fuel injection device for internal combustion engines according to claim 1, wherein the normally open check valve comprises a split ring disposed in the annular chamber, an open-close valve seated on a seat surface formed in the split ring by the force of a spring disposed in the supply passage, the open-close valve being adapted to open the supply passage by the spring force and close the supply passage by a fuel pressure greater than the spring force, and a positioning means to position the split ring on the control sleeve.

5. A fuel injection device for internal combustion engines according to claim 1, wherein the normally open check valve comprises a split ring having an opened portion and disposed in the annular chamber, an open-close valve having a leaf spring secured to the ends of the split ring on both sides of the opened portion, the leaf spring being adapted to open the supply passage by a spring force and close the supply passage by a fuel pressure greater than the spring force, and a positioning means to position the split ring on the control sleeve.

* * * * *